US005336296A

United States Patent [19]

Lupeiko

[11] Patent Number: 5,336,296

[45] Date of Patent: Aug. 9, 1994

[54] METHOD OF OBTAINING STEEL IN A LIQUID BATH AND THE DEVICE TO CARRY IT OUT

[75] Inventor: Vitold M. Lupeiko, Ekaterinburg, U.S.S.R.

[73] Assignee: Scientific Dimensions USA, Inc., New York, N.Y.

[21] Appl. No.: 30,195

[22] PCT Filed: Sep. 17, 1991

[86] PCT No.: PCT/SU91/00183

§ 371 Date: May 12, 1993

§ 102(e) Date: May 12, 1993

[87] PCT Pub. No.: WO92/05288

PCT Pub. Date: Apr. 2, 1992

[30] Foreign Application Priority Data

Sep. 18, 1990 [SU] U.S.S.R. ..... 4872626/02

[51] Int. Cl.[5] ..... C21B 13/14

[52] U.S. Cl. ..... 75/434; 75/528; 75/531; 75/537; 75/957; 266/212; 266/215; 266/901

[58] Field of Search ..... 75/434, 528, 529, 530, 75/540, 547, 531, 537, 957; 266/162, 212, 217, 215, 217, 900, 901

[56] References Cited

U.S. PATENT DOCUMENTS 3,565,605 2/1971 Vayssiere et al. .
3,701,519 10/1972 Vayssiere et al. .
3,772,000 11/1973 Hyde et al. ..... 75/529
4,981,285 1/1991 Agarwal et al. ..... 266/900

FOREIGN PATENT DOCUMENTS 1294982 2/1965 Fed. Rep. of Germany .
1758537 6/1968 Fed. Rep. of Germany .
410098 4/1974 U.S.S.R. .
1134607 1/1985 U.S.S.R. .
1004355 9/1965 United Kingdom ..... 266/215
1191065 5/1970 United Kingdom .

OTHER PUBLICATIONS

"Manufacturing Iron Without Blast Furnace", Metallurgy, Moscow, 1964, pp. 314–316, Pokhvistnev et al. with English Abstract.

*Primary Examiner*—Melvyn J. Andrews
*Attorney, Agent, or Firm*—Kenyon & Kenyon

[57] ABSTRACT

The proposed method is characterized in that the liquid bath is constituted by the melt of low carbon steel and molten slag. Oxidation and reducing zones are created through which, along a closed path on the surface of the molten low-carbon steel, is circulated the molten slag, into which are blown powder slag materials which are melted with the heat of a fuel oxygen torch immersed into the melt. The melting is carried out in a melting reservoir shaped as a closed annular chamber (1) provided with partitions (11) hermetically dividing the gas space above the molten slag into oxidation (6) and reducing (7) zones.

20 Claims, 2 Drawing Sheets

METHOD OF OBTAINING STEEL IN A LIQUID BATH AND THE DEVICE TO CARRY IT OUT

FIELD OF THE INVENTION

This invention relates to the field of ferrous metal, and more particularly to a method of obtaining steel in a liquid bath and a device to carry out this method.

1. Prior Art

Traditional methods of obtaining steel by multi-step technological techniques are well known, e.g., agglomeration-coke-chemistry-blast-furnace processes, steel-furnace processes (e.g., converter, martin, electrical steel furnace processes). All of these techniques have essential disadvantages: a large number of expensive main technological units with complicated auxiliary equipment; large total costs (labor costs included) to operate and repair the equipment; large inter-stage heat losses, relating to cooling intermediates; large costs for inter-stage transportation of intermediates; significant total heat losses, including heat losses at each technological unit; significant total losses of the iron extracted; limited ability to use the initial metal charge; and significant total environmental pollution with production wastes at each technological stage. Another known method is a method of obtaining steel in a liquid bath from charge materials comprising iron-containing raw material and slag-forming fluxes. The essence of this liquid bath method is to obtain low-carbon steel by interaction of iron oxides with a reductant, burning with an oxygen-containing gas to supply the process with heat, and introducing chemical additions to obtain the required chemical content of the desired low-carbon steel by an out-of-furnace method such as in a ladle. (Pokhvisnev A. N., Kozhevnikov I. Yu., Spektor A. N., Yarkho E. N. "Out-Of-Blast-Furnace Obtaining Iron Abroad", *Metallurgy,* Moscow, 1964, pp. 314–315).

In the liquid bath method, a liquid bath is formed first by melting iron, for example steel scrap, to form a liquid metal. The iron melt is continuously or periodically carbonized by saturating it with reductant by plunging carbonaceous electrodes into it or by blowing coal powder with the aid of methane into the melt. Pieces of iron-ore and slag-forming fluxes are continuously or periodically fed onto the surface of iron-carbonaceous melt. As a result of close contact with the reductant-carbon, dissolved in the iron melt, the iron is reduced, increasing the mass of iron-carbonaceous melt. Oxide impurities contained in iron-ore, are melted together with slag-forming fluxes to form a slag melt on the iron melt surface. This process of melting charge materials and reducing iron is provided with heat from burning fuel in oxygen-containing gas over the liquid bath. Before tapping, the iron-carbonaceous melt is decarbonized, stopping before hand the feeding of carbon-containing reductant into the melt. The low-carbon steel obtained has its chemical content corrected to the desired content by an out-of-furnace method.

A well known device to obtain steel in a liquid bath, e.g., a martin furnace, has a melting unit to initially melt charge materials, forms a liquid bath, and obtains low-carbon steel. The melting unit is formed with hearth-stones, walls, and an arch. It is provided with a device to introduce iron reductant in the liquid bath, means to feed charge materials, means to tap steel and slag out of it, a burner device to burn fuel inside the melting unit using from oxygen-containing gas, and a device to discharge burning wastes out of the unit.

An important characteristic of both this method and this device is a common technological area for carrying out both the oxidizing and reduction processes.

The atmosphere of the working space of martin furnace is of a very oxidizing character with respect to metal. This results from the necessity of complete burning the fuel. In addition, the oxidizing atmosphere makes the process of iron reduction slower, and iron, counteracting oxidizing gases-burnt products ($CO_2$ and $H_2O$) is actively reduced.

Thus, in the above method, two opposed metallurgical processes simultaneously take place: at the boundary of the contact of metal and slag, which contains iron oxides, iron is reduced; and at the boundary "metal-gas" —iron is oxidized. But mainly iron is oxidized due to reoxidizing iron oxides in slag because of the atmosphere in the furnace. Finally, it leads to an increase of the specific expenditure of reductant and lowers the rate of the reduction process.

Creating a reduction atmosphere over the melt by underburning the fuel will lead to an uneven increase of its specific expenditure. The option of decreasing the harmful influence on the reduction process by the oxidizing atmosphere of furnace, increase of the thickness of slag layer,—is analogous and it makes not only the oxidizing of the metal slower, but also a much slower heat assimilation of the melt.

The conditions of heat transmission to melt in an air furnace are not effective enough, mainly because of the comparatively small contact surface between the burning torch and the melt. The slag, even a boiling slag, has a very low heat conductivity. It does not permit speed up of the process of melting, which thus mainly results in low productivity, low heat efficiency and high specific expenditure of fuel.

The air furnace without breaking its stability and a waste of iron does not permit changing the air to burn fuel in oxygen, resulting in the increase of heat efficiency in the process.

Disclosure Of The Invention

The basis of the present invention is the task of developing a method of obtaining steel in a liquid bath and a device to carry out this method, to improve the technical and economic characteristics of melting steel of any metal charge by a direct one-step-process.

The problem to be solved is solved by the method of obtaining steel in a liquid bath using charge materials which contain iron-containing raw material and slag-forming fluxes. The method is directed to obtain low carbon steel by the interaction of iron oxides and reductant, burning the fuel in oxygen-containing gas to provide the technological process with heat, and introducing additious into the low-carbon steel by an out-of-furnace method to provide the required chemical content of steel which is obtained. According to the invention, a liquid bath is formed of an initial melt of low-carbon steel and steel-melting slag melt chemically in equilibrium with it. Technological oxidizing and reduction areas are formed along a closed contour through which the initial slag melt moves along the melt surface of the low carbon steel due to dynamically affecting the slag melt by a burning torch. The torch is formed by means of burning fuel in an oxygen containing gas and the torch is plunged into the slag melt in the oxidizing area of the closed contour. Powder type charge material is blown into the slag melt by air in the oxidizing area to increase the concentration of iron oxide and to refine the slag. Due to the heat of the plunged fuel-oxygen burning torch, the powder-type material is melted, and the slag melt is overheated compared to the temperature of melt of low-carbon steel to provide for the process of iron reduction out of the slag melt by heat. Because of the air-oxygen used to blow powdery materials into slag melt and the oxygen of fuel-oxygen burning torch, sulphur (being in the slag melt) is oxidized and removed from the overheated slag melt into a gas phase. An iron reductant is introduced into the overheated slag melt entering the reduction area and this results in a low carbon steel. Steel falls out of the slag melt in the form of drops and this results in a low carbon steel. Gaseous products of reduction are removed from the slag melt into a gas phase above it. The chemical content of the slag melt is reduced up to the initial chemical content of the initial slag melt, the initial mass of which travels into the oxidation area to carry out the next technological cycle. The excess of slag melt formed is removed from the technological process and the low-carbon steel obtained is sent to an out-of-furnace device for correction of its chemical content to the required one.

In this method of obtaining steel, providing heat to the process by immersing the torch burning fuel in oxygen into the slag melt increases the coefficient of heat usage of this fuel approximately by 2.5–3.0 times compared to the method of burning fuel in the air in the martin-type-furnace. This improvement in the use of the fuel is obtained by the following: The immersed burning torch, mixing intensively with slag melt, makes the value of the contact surface of the boundary between them ten to a hundred times more than between the slag melt and a fuel burning torch which is burnt in the air over the slag melt in the martin furnace. The rate of transmission of heat to the melt is increased proportionally to the increase of this contact surface. Heat exchange, being accelerated in such a way, causes the metallurgical process to be dramatically (by dozen times) intensified and heat losses are reduced with the products of burning which are withdrawn.

These heat losses are much more reduced due to substitution for air, spent to burn the fuel, by oxygen, in which nitrogen is practically absent. As a result of the use of plunged fuel-oxygen burning torch, the process of obtaining steel is intensified and the specific expenditure of fuel is reduced. Further, carrying out the metallurgical process according to the suggested method of obtaining steel successively in two areas, instead of one common area, permits carrying out the process of iron reduction out of the slag melt, providing it with heat, and the process of melting charge materials in the most favorable conditions. If these processes are carried out in a common area in semi-reduction—semi-oxidative conditions, they are carried out at a slower rate with much more fuel and iron reductant expenditure, as the products of the complete burning of the fuel are oxidized iron reductant, spending a great amount of fuel and reductant in addition on this process.

Thus, carrying out the process of obtaining steel according to the suggested method in two technological areas, instead of one common area, essentially permits reducing the specific expenditure of the fuel and the reductant and, other conditions being equal, to intensify the process of obtaining steel.

In the proposed method of obtaining steel, heat, which is necessary to carry out the reduction process, is transmitted into the reduction area with the help of the slag melt, containing iron oxides, by proper overheating of the melt with respect to the temperature of steel obtained. As it is mentioned above, overheating is more effectively carried out with the help of the plunged burning torch in the oxidizing area. Keeping this effectiveness on the proper level is reached by the multiple increase of the mass of slag melt at the expense of its initial part, dramatically decreasing the necessary temperature of its overheating, and therefore, heat losses with the products of burning fuel in the plunged torch which are withdrawn.

To keep this high effectiveness of heat feeding into the reduction area, the mass of the initial slag melt is sent again out of the reduction area into the oxidizing area for the next technological cycle, eliminating heat expenditure to prepare the initial slag melt. Use of the great mass of the initial slag melt, being used as thermogenerator, and moved in circulating conditions along the closed technological contour, allows, as much as possible, keeping a low specific expenditure of the fuel and the iron reductant while obtaining steel due to creation of the two-zone technological process.

In addition, low specific expenditure of the fuel and the reductant reduces the pollution of the environment with the products of burning, including carbon dioxide, thus improving the ecology.

To obtain maximum efficiency of the use of the slag melt as a heat carrier for the reduction zone, it is advisable to form the initial slag melt in the quantity determined from the ratio 2–15 kg of its mass to every kilogram of iron reduced from the slag melt and producing low-carbon steel. The temperature of overheating the slag melt before its entering the reduction zone is advisable to be within 50° and 300° C. This allows getting a high coefficient of heat use and a rather high resistance of the fire-proof lining, which becomes cool in the places of contact with the slag melt.

With the aim of minimum specific expenditure of the iron reductant to reduce iron out of its oxides, it is advisable to introduce the reductant into the overheated slag melt in the reduction area by dispersion in a quantity not less than that which is stochiometrically necessary to reduce the iron out of its oxides.

To obtain minimum specific expenditure of the fuel, gaseous products of iron reduction, which are formed in the reduction zone, can be ejected into the plunged fuel-oxygen burning torch, where they are burnt in oxygen.

To reduce the specific expenditure of the reductant and the fuel, to prolong the life-time of the fire-proof lining of the melting area, and to accelerate the process, reductant in a quantity being enough to reduce $Fe_3O_4$ up to FeO is introduced by dispersion into the slag melt which is in the oxidative zone.

To accelerate the processing of the steel scrap contained in the charge into low-carbon steel melt, it is advisable to charge the steel scrap under the slag melt in the oxidative zone, and to blow off low-carbon steel melt around it with the streams of oxidative gas in order to melt the scrap and to transfer iron oxides being formed into the slag melt. Iron oxides are then reduced to obtain low-carbon steel.

In order to reduce heat losses and the specific expenditure of the fuel oxygen, fuel-oxygen is used as an oxidative gas while melting the scrap.

To reduce the formation of brown smoke and iron wastes with it during the process of melting, as well as to reduce the costs of gas-washing, the products of complete burning of fuel-oxygen torch can be used as an oxidative gas. In addition, it is advisable to keep the concentration of $Fe_3O_4$ low enough to transfer it into FeO, with the CO and $H_2$ being formed accordingly being transformed into $CO_2$ and $H_2O$ in the slag melt under the streams of the burning torch.

It is advisable to keep the necessary concentration of $Fe_3O_4$ in the slag melt by introducing the proper amount of iron-ore material into the slag melt to use the fuel more effectively while melting the scrap with the fuel-oxygen torch.

Keeping the necessary concentration of $Fe_3O_4$ in the slag melt is carried out by blowing it off with oxygen to use the fuel more effectively while melting the scrap due to blowing off the melt with the streams of the fuel-oxygen burning torch when the portion of the iron-ore material in the charge is small.

To increase the value of the slag, which is formed at the same time in the process of obtaining steel, it is advisable to choose such a ratio of powdery slag forming flux materials, being blown into the slag melt, which provides the slag chemical content at the end of the reduction zone to be close to the chemical content of portland cement.

To make the process of obtaining alloyed steel cheaper, ore raw material containing the oxides of the proper alloying elements is introduced into the slag melt in the oxidative zone.

The problem is also solved by the device, which practices the method mentioned above. The device contains the melting chamber for creating the liquid bath and melting the charge materials, comprising a hearth, walls, and an arch, and is provided with a device to introduce the iron reductant into the liquid bath, a device to charge the materials, a device for charging and burning the fuel inside the chamber, and a unit to tap steel and slag out of the chamber. According to the invention, the melting chamber is a closed circle chamber, equipped with a device for cooling walls and with the partitions fastened in the arch and the walls with the possibility of a hermetic division of the gas cavity over the slag melt into oxidative and reduction zones according to the technological zones of the process. The device to charge the powdery charge materials and the device to feed and burn the fuel inside the chambers are located in the technological oxidative zone and are made in the form of tuyeres plunged into the slag melt. The device to introduce the iron reductant is located in the technological reduction zone, in its initial part with respect to movement of the slag melt, and is made in the form of at least one tuyere immersed into the slag melt. The device to tap steel and slag out of the chamber includes holes for tapping steel, located in the reduction zone, and the holes for tapping slag located at the end of the reduction zone with respect to movement of the slag melt at the boundary with the oxidative zone.

Making the melting chamber in the form of circular closed melting chamber with the partitions permits the arrangement of the technological process for obtaining steel more effectively, because the melting chamber along the circle contour is divided into a number of technological parts, through which the slag melt is being continuously moved along the closed contour. Every particle of the slag melt passing through these parts is subjected to the corresponding technological operations. Thus, on entering the oxidative zone, the slag melt passes through the part with tuyeres located in the oxidative zone to blow in the powdery charge materials and the tuyeres to burn the fuel in the oxygen by the plunged burning torch. After that, the slag melt enters the section of its overheating, where tuyeres are located for blowing the slag melt with the plunged fuel-oxygen burning torch. Due to the position of the nozzles in the fuel-oxygen tuyeres, which are directed to moving the slag melt, the slag melt gets the dynamic influence of the streams of the burning torch and is continuously moving along the closed circle melting chamber. On entering the reduction zone, the slag melt passes through the section with tuyeres located in it to blow the iron reductant into the slag. Then this slag melt passes through the section for the precipitation of the low-carbon steel drops being formed by the reduction. At the end of the reduction zone and the metal drops precipitation section, the mass of slag formed during the technological cycle is removed out of the melting chamber by the tapping unit. Due to the closed circle melting chamber, the mass of the initial slag is kept during the process, entering the oxidative zone to take part in the new technological cycle. Thus, the closed circle chamber allows the initial slag melt to be used many times, saving essentially the materials and the energy used to prepare it.

In addition, creating the device with a hermetic cross division of the gas cavity over the slag melt into the oxidative and reduction zones of the melting chamber, made in the form of the closed circle, wherein the oxidative zone is provided with tuyeres to introduce the powdery charge materials into the melt and with the fuel-oxygen burning torch, and wherein the reduction zone has the tuyeres to introduce the iron reductant, permits realization of the proposed method of obtaining steel with maximum efficiency.

It is advisable for the fuel-oxygen tuyeres to be located vertically and to have the blow nozzles in its lower part on the lateral surface, with the holes of the nozzles being directed to moving the slag melt.

This results in the use of the plunged burning torch to heat the slag melt and to move along the circular melting chamber with maximum efficiency.

It is advisable to provide the device with the scrap-charging hole in the middle section of the oxidative zone and with scrap-melting oxygen and fuel-oxygen tuyeres at both sides of the scrap-charging hole.

This arrangement permits the charging and melting of steel scrap with high efficiency.

Tuyeres for introduction of the reductant into the slag melt and fuel-oxygen tuyeres for overheating the melt can be located at the beginning of the second half of the oxidative zone with respect to the movement of the slag melt.

This arrangement results in overheating the slag melt with preliminary iron reduction most effectively before the slag melt goes into the reduction zone.

It is advisable for the device to have means to introduce liquid cast iron into the slag melt. This device should be located in the initial section, with respect to the direction of the movement of the slag melt, of the reduction zone, followed by the section for the precipitation of the reduced iron.

This results in more effective use of liquid cast iron as an iron reductant.

It is advisable for the reduction zone to be provided with a gas removing safety valve.

This gas-removing safety valve prevents an emergency in case of a sudden rise of gas pressure in the reduction zone.

It is advisable for the device to be provided with an ejector gas-removing unit which connects the gas cavity of the reduction zone with the tuyeres which blow oxygen and fuel into the slag melt to burn the fuel in order to use as much as possible the potential thermal energy of the gas products of the iron reduction.

BRIEF DESCRIPTION OF THE DRAWINGS

The present invention is further explained by the detailed description of a particular example of its performance with references to the accompanying drawings, where.

THE BEST MODE OF CARRYING OUT THE INVENTION

Figure 2:
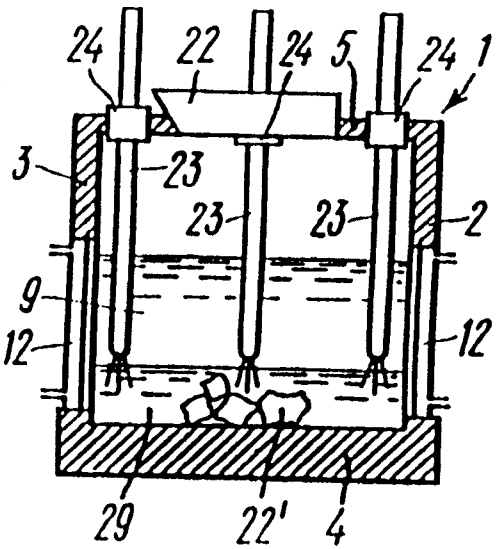
FIG. 2 is a part section along the line II—II in FIG. 1.

A proposed method of obtaining steel is the following:

First of all a liquid bath is formed out of an initial element of a low-carbon steel melt and a steel-melting slag melt being in chemical equilibrium with the low-carbon steel melt and which is continuously moved in the recirculating regime along the closed contour which is divided into oxidative and reduction technological zones.

The following technological operations are successively carried out in the oxidative zone:

The powdery charge and the fuel-oxygen burning torch are blown into the initial slag melt with air. The charge is melted with the help of the burning torch and simultaneously sulphur is removed from the slag with the help of oxygen and air.

Before entering the reduction zone, the slag melt is overheated with the help of the immersed fuel-oxygen burning torch to provide the process of iron reduction out of FeO with heat. For peculiar conditions, this can be followed by the additional purification of the slag melt from sulphur.

After the slag melt enters the reduction zone from the oxidative zone, the following technological operations are carried out:

The reductant is introduced into the slag melt. The reductant can be gas (for example, natural gas or hydrogen) or liquid (for example, mazut) or powder (for example, coal powder), which is blown or injected into the bulk of the slag flow.

It is possible to use these reductants in combination. The quantity of the reductant should be not less than that which is stochiometrically necessary to reduce iron from FeO up to the required residual concentration of iron in the slag. The concentration depends in particular on the process of dephosphorization.

After introducing the reductant into the slag melt, the slag melt is moving along the quiet part for the separation of the metal from the final slag melt by the precipitation of metal drops in the slag melt to the bottom zone containing the metal melt of the low-carbon steel.

After the precipitation of the reduced metal is finished, the mass of the slag melt at the end of the reduction zone is divided into two parts: the initial part (the mass of this slag flow is constant), which is sent into the oxidative zone to use it in the next technological cycle, and the removed part of the slag melt, which is removed from the continuing technological cycle.

The resulting low-carbon steel is removed from the process and sent to correct its chemical content by an out-of-furnace method.

The proposed method has a number of additional specific embodiments for the technical effect obtained to be optimized.

First, the optimum temperature of overheating the whole slag flow of the initial slag and ore-flux melt, melted and mixed with it before going into the reduction zone, is kept higher than the temperature of the metal bath within 50° to 300° C., being, for example, 1650°-1900° C.

In this case, the optimum mass of the initial slag melt running through the reduction zone for reducing iron out of FeO is kept within 2 to 15 kg for 1 kg of the iron being reduced.

These quantitative parameters, which are in close connection, are determined on the basis of the analysis and calculations of the thermal balances of the process of obtaining steel according to the technique proposed.

The initial point was that the maximum temperature of overheating the slag melt is determined equal to 1900° C. Its further increase could significantly reduce the resistance of fire-proof lining of the melting unit contacting the slag melt, significantly reducing the thermal efficiency of the melting unit, and increasing the specific expenditure of the fuel.

The second point, taking into account the possibility to easily control the chemical content of the slag melt in the proposed technique, is that it is advisable to keep the optimum chemical content of the regenerative initial slag melt, similar to the typical steel-melting slags with increased base (2.5-3.5) at a content of CaO (55-60%) and reduced concentrations of FeO (6-8%) and MgO (2-4%). Such a slag has not only good refining properties, but it can be used as almost prepared raw materials to make portland-cement.

The third, a reductant in a quantity not less than the stochiometric amount needed to reduce iron oxides to FeO is blown into the slag melt, containing iron oxides, introduced with the charge.

The fourth, while using steel scrap in the charge for its accelerated melting, gaseous oxygen is used for the oxidation of the iron. The scrap is charged with equal parts into the metal bath of the melt of low-carbon steel located under the slag, and the steel is blown in the zone of charging the scrap with the help of oxygen streams. Oxidation of liquid metal occurs, mainly the iron, and adequate increase of the temperature of the liquid metal bath occurs. Due to its high heat conductivity and contact with oxygen streams, rapid heat transmission to the scrap takes place and the scrap is melted with acceleration. Calculation shows that it is necessary to oxidize about $\frac{1}{3}$ of iron from the mass of the scrap to FeO to melt the scrap completely.

If it is necessary to reduce evaporation of iron during blowing. Blowing in the metal bath is carried out with a fuel-oxygen burning torch. While blowing the metal bath with fuel-oxygen burning torch, the products of complete burning ($CO_2$ and $H_2O$), oxidized metal dissociates with CO and $H_2O$. To use more effectively their thermal and chemical energy in the slag melt (in the area of melting the scrap), the concentration of $Fe_3O_4$ is maintained at such a quantity, which is sufficient to oxidize (about by 95–99%) the bubbles coming to the surface of the slag, and containing CO and $H_2$, up to $CO_2$ and $H_2O$. Calculation shows that in this case, the mass of $Fe_3O_4$ in the slag, which interacts with CO and $H_2$, must not be less than 7.5 times more than the mass of oxygen in the plunged burning torch, with the help of which scrap is melted. Such a concentration of $Fe_3O_4$ is reached automatically while melting steel out the charge, containing, besides scrap, ore concentrate in the quantity sufficient for it (for example, when iron goes into steel out of the scrap not more than 20–25%). If steel is melted, for example, only from single scrap, a method is used to keep the necessary concentration of $Fe_3O_4$, which is to blow the slag melt with oxygen only in the area of the location of scrap-melting fuel-oxygen tuyeres, for example, by introducing oxygen through the upper layer of oxygen nozzles, located in the same tuyeres. Due to these oxygen streams, ferrous oxide (FeO) will be oxidized to $Fe_3O_4$, inducing an appreciable amount of heat into the slag. The quantity of oxygen for this purpose, as calculations show, is approximately not less than a half (50%) of the quantity of oxygen spent by the plunged burning torch, with the help of which scrap is melted.

The optimum concentration of $Fe_3O_4$ in the slag melt is kept, as a practical matter, on the basis of continuous express-analysis of gases being emitted out of the melt in the zone of scrap melting.

Iron oxides, formed while blowing the scrap or blowing the metal bath both with oxygen and with the fuel-oxygen burning torch, go into the slag melt, out of which the iron is extracted into low-carbon steel in the reduction zone by the method mentioned above.

Calculations show that such a method of accelerated processing of scrap into steel, compared with the known method, needs less total energy expenditure and results in getting the biggest yield of iron from scrap.

The correlation of scrap and ore concentrate in the charge can be any one (0 to 100% ).

According to the same technological scheme, one can melt the scrap, containing alloying elements, which are kept in the prepared steel in substantially the same quantity.

The method of direct blowing of the scrap with blowing oxygen streams and the fuel-oxygen burning torch can be also used.

The fifth, while melting steel, which should contain alloying elements, these elements are added in the form of solid or liquid ferroalloys in the required quantity to the low-carbon steel which has been tapped into a steel holding ladle. An adequate quantity of carbon-containing material is also added there to reach the required concentration of carbon in the steel.

The sixth, during the smelting of the alloyed steel, alloying elements may be added in it on the move by their reduction according to the above described technological scheme, which is typical for iron reduction. For this purpose, they are blown into the starting slag flow iron-ore concentrate together with the appropriate amount of ore or concentrate, containing oxides of the elements required for alloying. According to such a technological scheme, in the present apparatus, it is possible to melt ferroalloys also by increasing the upper temperature level of metal melt (e.g. up to 1850° C.) and the slag melt (e.g. up to 2000° C.) as well.

The seventh, if cast iron is used as a reducing agent, it is inserted into the slag melt in the form of small pulverized drops.

The eighth, combustible gas formed during reduction may be sucked out from reducing gas cavity by means of special ejector device and directed to the fuel-oxygen tuyeres of oxidizing zone burning plunged torch, where it is used as a fuel or reductant.

Analysis compared with the prototype permits the conclusion that the applied method of steel making differs in that the technological scheme stipulated above is based on a principally new technological solution of providing heat to the iron reduction reaction zone. This solution consists of giving to the slag melt a new additional role or function of the sole heat carrier for the reduction zone.

This function of the slag is obtained by a new combination of methods: artificial increasing of slag melt mass and its overheating compared to the temperature of the obtained steel. In this case, the mass of the slag melt is increased by mixing ore-flux melt with starting slag melt, which chemical composition corresponds to the one of final slag. If steel is obtained by this method, both melts are in chemical equilibrium. The starting slag melt within such a technological scheme is permanently used in the recycling mode.

Overheating of slag melt (flow) is carried out prior to performing the iron reduction process by means of an immersed fuel-oxygen burning torch where the additional fuel may be also combustible gas ejected from the reducing zone.

At the same time, because of the leak—tight separation of gas cavity of ring melting chamber oxidating zone, where slag melt overheating occurs, from the gas cavity of the reducing zone, the reaction zone of iron reduction from FeO, the latter zone is not affected by oxidation of burning products thus causing the technological process effectiveness to increase.

In addition, a new feature in principle in the offered technological scheme is a new combination of methods allowing the production with high effectiveness of steel from scrap in combination with any amount of an ore component of the charge (from 0 to 100%). This combination includes speedy melting of scrap due to intensive iron oxidation by a gaseous oxidant ($O_2$ or $CO_2$ with $H_2O$) which is followed by iron oxide reduction according to scheme described above.

This allows the use of the proposed method for a cokeless one stage direct production of high quality steel from any metallic charge with high productivity, low specific fuel consumption, significantly less environmental pollution, and with the production of slag as a half-product for portland cement as well, and, finally, to reduce specific consumption of fuel and hence the environment pollution by burning products by 1.5–2.5 times.

Figure 1:
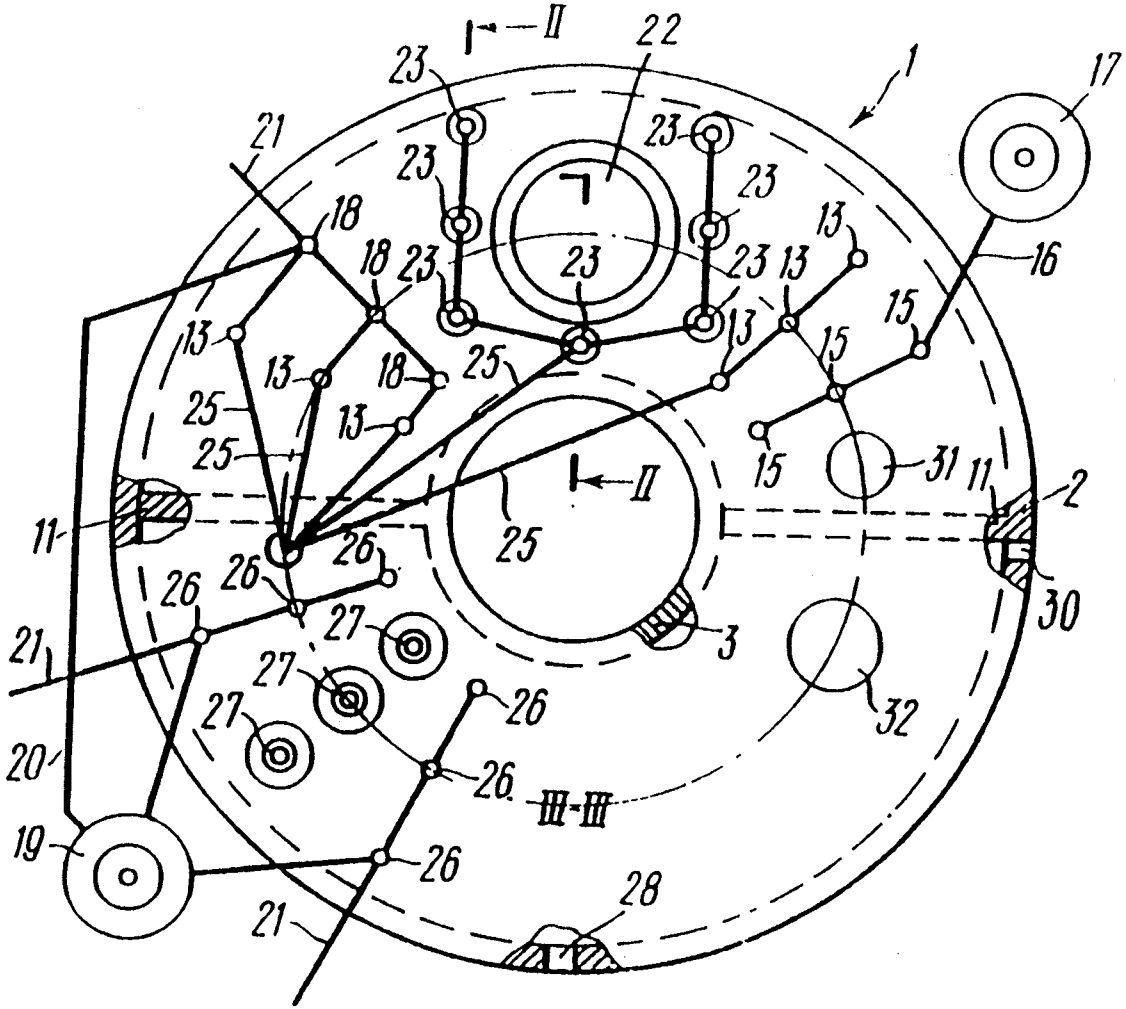
FIG. 1 represents schematically a general plan view of the proposed device for obtaining steel.

With reference to FIG. 1, the proposed method of steel production is most effectively carried out in apparatus having a melting chamber 1 formed as a closed hollow contour of any shape, preferably a circle. Melting chamber 1 is formed by outer ring 2 and inner walls 3, bottom 4 (FIG. 2) and crown 5. In cross-section, the melting chamber 1 preferably is rectangular. Ring melting chamber 1 contains two technological zones: oxidating zone 6 (FIG. 3) and reducing zone 7. Gas cavity 8 above slag melt 9 of oxidating technological zone 6 is leak tight separated from gas cavity 10 above slag melt 9 of reducing technological zone 7 by transverse partitions 11. Walls 2 and 3 and partitions 11 in the area of contact with slag melt 9 are equipped with outer cooling elements, e.g., panels 12. Damp steam is preferably used as the cooling agent.

Walls 2 and 3 located above slag melt 9 (non-foamed) may be made inclined outward from ring axis plane III—III. With a fixed height for the ring melting chamber 1, this will increase the volume of its gas cavities 8 and 10 ensuring no over filling with foamed slag melt 9.

Vertical plunging fuel-oxygen tuyeres 13 (FIGS. 1 and 3) are placed inside the inner cavity of melting chamber 1 in the oxidating technological zone 6. Tuyeres 13 have located in a side surface of their bottom parts blowing nozzles 14 (FIG. 3) which are directed (according to arrow A) to move the slag melt 9.

Tuyeres 13 are arranged in two groups: one—at the first half of oxidation zone 6 according to the direction of slag melt 9 flow (arrow A); another—at the second half. Gas-powder tuyeres 15 are located in oxidation zone 6 (FIGS. 1 and 3) for the purpose of blowing charge powder materials into slag melt 9, tuyeres 15 are supplied through pipeline 16 by pneumatic apparatus 17. The number of such tuyeres depends on specific work conditions of the apparatus and its productivity.

In the same oxidating technological zone 6 after tuyeres 13 and 15 according to slag melt flow direction (arrow A), two vertical plunged blow tuyeres 18 are placed to blow into slag melt 9 a powder reducing agent for $Fe_3O_4$ to FeO reduction. A powder reducing agent is supplied to tuyeres 18 by pneumatic apparatus 19 through pipeline 20. If a gaseous or liquid reducing agent is used, it is supplied to tuyeres 18 through pipeline 21.

The total number of tuyeres 13, 15 and 18 in the apparatus, the number in each row located transverse to the ring melting chamber 1, and the number of such rows depends on the chamber dimensions, apparatus productivity, and the specific technological conditions of the steel production process. It is also possible to place tuyeres 15 and 18 in the same row with tuyeres 13.

In the middle part of oxidating technological zone 6, the crown 5 is equipped with scrap charging opening 22 intended for steel and slag melts pouring when starting liquid bath, and steel scrap charging when the liquid bath is formed, if it comprises iron-content materials. Moreover, lump charge materials may be inserted through the opening 22. Around scrap charging opening 22, mobile scrap melting oxygen and/or fuel-oxygen tuyeres 23 are positioned. These tuyeres 23, as well as tuyeres 13, 15 and 18, are equipped with a mechanism (not shown in Figure) to move them in the vertical direction. Moreover, tuyeres 23, may be equipped with a swing mechanism 24 (FIG. 2) by means of which they may perform a pendulum move within a given angle of inclination (FIG. 3) from the vertical line. All the tuyeres are cooled with water or damp steam.

The apparatus is equipped with gas pumping ejector pipe 25 (FIG. 3) connecting gas cavity 10 of reducing technological zone 7 with fuel-oxygen tuyeres 13 and 23. Gaseous products formed during iron reduction are transported through this pipeline 25 in the direction of arrow B to tuyeres 13 and 23 where they mix with oxygen and burn in the plunged torch.

Tuyeres 26, for the purpose of blowing iron reducing agent into slag melt 9, are located in the inside inner cavity of melting chamber 1 in its reducing technological zone 7 at area where the slag melt 9 blows in from the oxidating technological zone 6.

If a powder reducing agent is used, tuyeres 26 are connected with pipeline 20 through which reductant is supplied from pneumatic apparatus 19. The number of the apparatuses 19 and tuyeres 26, as well as the tuyeres' specific placement at given area of zone 7, depends on the steel production apparatus' specific dimensions, its productivity, and technological conditions.

In the case of using liquid cast iron as the reducing agent, the area of tuyeres 26 placement is equipped with a means containing a vortex 27 with pulverizer for the inserting of dropped cast iron into the slag melt 9. The device for steel production has an opening 28 to discharge produced steel 29 and it is equipped with a discharging device to ensure uninterrupted output of steel. It is located in the reducing technological zone 7, preferably at its center. At the end of zone 7—according to the slag melt 9 movement (arrow A)—opening 30 is placed for slag melt 9 discharge, which is formed during steel 29 production by performance of the technological cycle (dumped slag).

Figure 3:
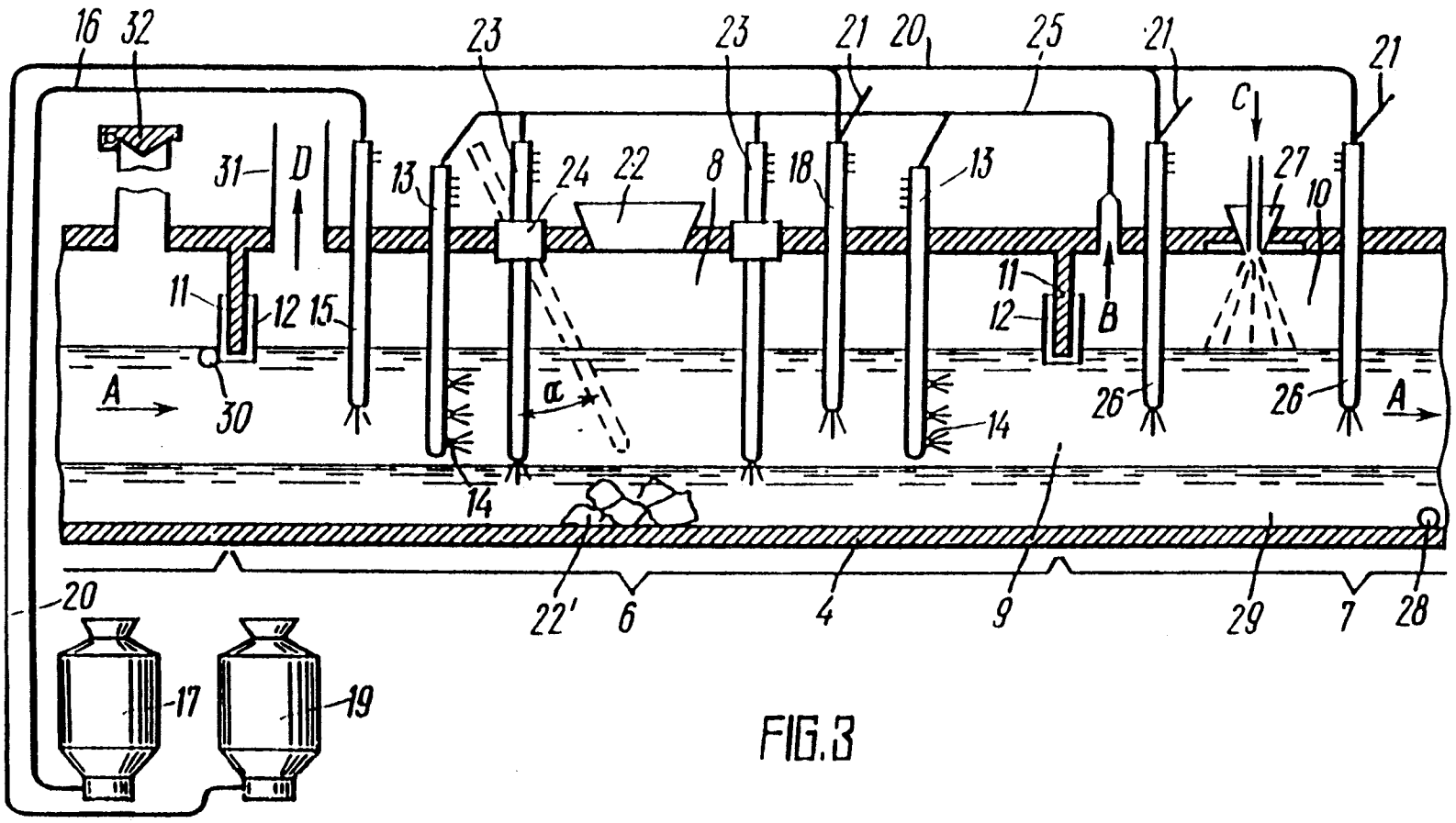
FIG. 3 is a section along the plane III—III of the device for obtaining steel in FIG. 1.

The device is equipped with a gas withdrawal 31 placed in technological oxidating zone 6 intended to withdraw burning products in the direction of arrow D (FIG. 3).

This withdrawal 31 may be combined with opening 22 or tuyeres 23 and an assembly is provided (not shown in Figures) for scrap heating by waste gases with a recuperator (not shown in Figure) for heating oxygen and fuel by these waste gases.

To ensure safe work conditions at the device, the technological reducing zone 7 is equipped with emergency relief valve 32 to automatically keep this zone at a gas pressure not exceeding a given value.

Technological processes according to proposed method are performed in the following way.

First of all, in ring melting chamber 1, a liquid bath is formed by pouring into it a low-carbon steel prepared at another steel making apparatus. Then above steel melt, a slag melt 9 is poured, e.g., blast-furnace slag, wherein fuel-oxygen tuyeres 13 are immersed into the slag melt with a preliminary turning on of a supply of fuel and oxygen. After heating of the slag melt to a working optimal temperature of 1600°–1750° C. is carried out, there is an adjustment of the chemical content and mass to values which meet the given ones desired to obtain a starting slag composition. This adjustment is performed by blowing into slag melt 9, by means of pneumatic apparatus 17 and tuyeres 15, the required amount of corresponding powder charge materials. At the same time, a suitable amount of heat sufficient for melting of materials is provided in the slag melt by tuyeres 13. When the liquid bath forming is completed, gas-powder tuyeres 15 and pneumatic apparatus 17 blow powder charge materials needed for steel producing into the slag melt 9.

Due to fuel-oxygen tuyeres 13 being placed at the first half of zone 6, the materials are melted keeping the optimal temperature (1600°–1650° C.) of slag melt 9 and conditions are created for its flow to scrap melting zone 22. Another portion of scrap 22' is charged on bottom 4 through opening 22 by a charging mechanism and it is melted intensively by scrap melting tuyeres 23 and, if necessary, by use of swing mechanisms 24. Maximum bringing of tuyeres nozzles 23 closer to the scrap surface or metal bath results in melting of scrap 22' and the simultaneous intensive surface iron oxidation or the oxidation of the low-carbon steel melt 29 and its transfer into the slag as FeO. At the same time admixtures of melted metal are subjected to oxidation as well a resulting in the conversion of scrap into low-carbon steel.

In technological oxidating zone 6, there is an intensive performance of cleaning sulphur from the slag melt 9. The sulphur is oxidized due to the oxygen of the burning torch, pneumatic apparatus air, and fluxes of a scrap oxidating agent, and it is exhausted (arrow D) from the apparatus as sulphuruous gas with burning products. Such a process of slag melt desulphuration results in the melt being a low-sulphur steel. When the slag melt 9 comes into the area of tuyeres 18 in oxidation zone 6, a reductant is blown into the melt by tuyeres 18 for preliminary reduction ($Fe_3O_4 \rightarrow FeO$).

If a powder reducing agent is used, it is supplied to tuyeres 18 by pneumatic apparatus 19. If a gaseous or liquid reducing agent is used, it is supplied into tuyeres 18 from pipeline 21.

Slag melt 9 contains iron oxides only as FeO oxides when it enters the area where the second group of fuel-oxygen tuyeres 13 are placed, and the slag is overheated by these tuyeres up to a temperature of 1650°-1900° C. and the slag melt is moved into reduction technological zone 7. When the slag melt comes to reduction zone 7, reducing agent is blown into it by means of tuyeres 26. If the reducing agent is in form of powder, it is supplied to tuyeres 26 by pneumatic apparatus 19. When using a gaseous or liquid reductant, it is supplied to tuyeres 26 from pipeline 21. When using liquid cast iron as a reducing agent, it is poured (arrow C) through vortex 27 with a pulverizer onto the slag melt. Dropped cast iron depositing through the slag melt reduces the iron. At this time, the balance between the mass of cast iron and mass of slag melt reacting with it is kept certain, which permits obtaining a given amount of cast iron refined to low-carbon steel and simultaneously reducing from slag melt 9 a given amount of iron. During precipitation, steel drops are refined from phosphorus and sulphur and the steel drops enter the low-carbon steel melt. Melted scrap metal also enters the steel melt. When such metals are mixed, it is taken into consideration that the resulting metal obtained from scrap both by direct melting and by reducing its oxidized fraction will be very pure as regard to admixtures. When using liquid cast iron, and there is a necessity of obtaining mid- and high-carbon steel, the cast iron is refined proceeding from the necessity to obtain a residual carbon in it which with mixing with another low-carbon metal will allow production of a steel with given carbon content. Final correction of the melted steel chemical composition is performed after the steel is discharged through the outlet opening 28 by an out-of-furnace method, e.g., in the ladle. Metal carbonizing may be carried out in apparatus by the blowing of carbon-containing powder by means of tuyeres 26 plunged into metal. After passing through precipitation zone where the steel drops are separated from the slag melt 9, the slag melt 9 is divided into a dump part discharged from opening 30 and the residual part in the apparatus is supplied into the oxidation technological zone 6 to be used at the starting point of the melt 9 in a recurrent technological cycle passing in continuous recirculation.

EXAMPLE 1

Steel production is performed from iron-containing raw materials comprising steel scrap which contained: C=0.3%, Si=0.15%; Mn=0.3%; P=0.945%; S=0.045%.

In front section of oxidation technological zone there is blown into the starting slag melt a corresponding powder slag-forming flux materials (lime, bauxite, iron scale etc.). A fresh part of slag melt (slag of refinement) is prepared having the same chemical composition as the starting one (CaO=60%. $SiO_2$=20%; $Al_2O_3$=8.0%; MgO=3.0%. FeO=7.0%; Mn=1.0%; basicity 3.0). The slag refinement amount totaled 250 kg per ton of scrap. The starting slag amount was kept at the level of 75 kg per kg of reduced iron which corresponds to 2430 kg per 1 ton of method scrap. By means of blowing through this zone of slag melt by plunged fuel-oxygen burning torch (with angle=1.0-1.1) heat was supplied to the melt sufficient to melt slag-forming materials blown into it and keep the slag melt temperature at level of 1600°-1650° C. Combustible gas from the reducing technological zone was used as a fuel which was ejected by oxygen by means of ejecting nozzles to fuel-oxygen tuyeres. The amount of this gas totaled about 3% of the whole mass formed during reduction, the gas comprising CO, $H_2$, $CO_2$, $H_2O$ and $N_2$. The amount of oxygen spent on ejecting and burning totaled 30.0 $m^3$/t. A part of heat given off was spent on heating of the air of the pneumatic apparatus and on compensating for heat losses through the apparatus housing at this zone. Due to free oxygen in the plunged burning torch ($1.1 < \text{angle} > 1.0$) the slag melt was extensively desulphurated by oxidizing this sulphur to $SO_2$ and by removing it from the melt with the burning products. The residual concentration of sulphur in the slag melt did not exceed 0.01%.

Through the scrap charging opening in technological zone, the bath was charged with scrap which immersed into the steel bath, and which was blown by oxygen with a specific consumption 68.5 $m^3$/ton of scrap. Due to reduction of iron of the low-carbon steel melt (324.5 kg per 1 ton of scrap), an amount of heat was given off sufficient for rapid scrap melting and heating to 1600°-1630° C. At this time, melted metal, due to extensive bubbling contact with slag melt, was cleaned from sulphur and phosphorous and due to oxygen—from carbon, silicon, and manganese.

Iron oxides, especially FeO, formed after the low-carbon steel melt oxidation resulting from oxygen blowing and with a certain amount of $Fe_3O_4$, in an amount of about 60 kg of Fe per 1 ton of scrap slag melt, moved to the end of oxidation technological zone.

The invention may be realized with most success at metallurgical enterprises doing steel smelting used for rolled metal (sheets, rails, girders, corners and other profiles) production. Moreover, the invention, on a level with known methods and apparatus for steel production, may be used in the machine building industry for steel casting production.

I claim:

1. A method for obtaining steel in a liquid bath using charge materials comprising iron containing raw material and slag forming flux material, said method comprising:

providing a melt chamber having an annular closed contour shape, and dividing the melt chamber into an oxidation zone having a first end portion and a second end portion and a reducing zone having a first end portion and a second end portion, with the second end portion of the oxidation zone being adjacent to the first end portion of the reducing zone, and with the second end portion of the reducing zone being adjacent to the first end portion of the oxidation zone;

introducing into said melt chamber an initial mass of molten low carbon steel melt and an initial mass of steel making slag melt in chemical equilibrium with said molten low carbon steel, said molten low carbon steel melt having a top surface with said slag melt being disposed on the top surface of said molten low carbon steel melt;

hermetically sealing a gas phase in the melt chamber above the slag melt in the oxidation zone from a gas phase in the melt chamber above the slag melt in the reducing zone;

practicing a continuous process cycle comprising:

immersing an oxygen-fuel burning torch into said slag melt in said oxidation zone, burning fuel in oxygen in the slag melt in said oxidation zone, and moving the slag melt along the top surface of said molten low carbon steel melt in a selected direction around said closed contour melt chamber by discharging fuel and oxygen containing gas from said oxygen-fuel burning torch;

charging powder slag forming flux material into said slag melt in said oxidation zone, and melting said charged powder slag forming flux material in said oxidation forming additional slag melt in said oxidation zone;

charging iron containing raw material into the low carbon molten steel melt in said oxidation zone, and melting and oxidizing said charged iron containing raw material in said oxidation zone thereby providing low carbon molten steel in the low carbon steel melt and iron oxides in the slag melt;

oxidizing sulphur in said slag melt in said oxidation zone and removing the oxidized sulphur as gas into the gas phase above the slag melt in said oxidizing zone, heating the slag melt in the oxidation zone to a temperature greater than the low carbon steel melt temperature thereby providing overheated moving slag melt leaving the second end portion of the oxidation zone and entering the first end portion of the reducing zone;

introducing an iron reductant into the overheated moving slag melt in the first end portion of the reducing zone and precipitating low carbon molten metal as molten metal drops from the slag melt into the low carbon steel melt in a precipitation section of said reducing zone and reducing the slag melt chemical content to the initial slag melt chemical composition;

removing from the melt chamber low carbon steel from said low carbon steel melt in the reducing zone at a location after the precipitation section;

removing from the melt chamber excess slag from said slag melt in the second end portion of said reducing zone with the slag melt leaving the second end portion of said reducing zone and entering the first end portion of said oxidation zone having a mass about equal to the initial slag melt mass.

2. A method according to claim 1 comprising providing the initial slag melt mass having a ratio of 2–15 kg of slag melt to 1 kg of iron precipitated from the slag melt, and overheating the slag melt leaving the second end portion of the oxidation zone to a temperature of 50° to 300° C. greater than the low carbon steel melt temperature.

3. A method according to claim 1 further comprising introducing iron reductant in the overheated slag melt in the reducing zone by dispersing a quantity of iron reductant into the overheated slag melt in an amount no less than the stochiometric amount required to reduce iron from iron oxides in the slag melt.

4. A method according to claim 1 further comprising removing gaseous products of iron reduction in the reducing zone from the gas phase above the slag melt in the reducing zone, and ejecting said removed gaseous products into the oxygen-fuel burning torch and burning said gaseous products as fuel.

5. A method according to claim 1 further comprising introducing iron reductant into the slag melt in the oxidation zone by dispersion in a quantity sufficient to reduce $Fe_3O_4$ to FeO.

6. A method according to claim 1 further comprising charging steel scrap into the low carbon steel melt under the molten slag in the oxidation zone, and blowing the low carbon steel melt around the charged scrap steel with streams of oxidative gas for melting the steel scrap and transferring iron oxides formed into the slag melt.

7. A method according to claim 6 wherein the oxidative gas is oxygen.

8. A method according to claim 6 further comprising using gaseous products of complete burning by the oxygen fuel burning torch as oxidative gas, maintaining $Fe_3O_4$ amount in the melt slag in the oxidation zone to an amount that can be reduced to FeO in the oxidation zone, and converting CO and $H_2$ formed in the slag melt into $CO_2$ and $H_2O$.

9. A method according to claim 8 further comprising controlling the amount of $Fe_3O_4$ in the slag melt by controlling the amount of iron containing material charged into the oxidation zone.

10. A method according to claim 8 further comprising controlling the amount of $Fe_3O_4$ in the slag melt by controlling the blowing of streams of oxidative gas.

11. A method according to claim 1 further comprising selecting a ratio of slag forming powder flux material charged in the slag melt in the oxidation zone to result in the slug melt in the second end portion of the reduction zone having a chemical composition close to the chemical composition of portland cement.

12. A method according to claim 1 further comprising charging alloy steel ore raw material having oxides of selected alloy elements into the molten low carbon steel melt in the oxidation zone.

13. A method according to claim 1 further comprising adding alloy elements to the molten low carbon steel removed from the reducing zone to outside the melt chamber.

14. A device for obtaining steel from a liquid bath comprising a slag melt disposed on an upper surface of a molten low carbon steel melt comprising:

a melt chamber comprised of a closed circular chamber having a bottom, two spaced apart side walls, and a top defining the melt chamber; two spaced apart partitions disposed in the chamber, each partition connected to the top and two side walls; said two spaced apart partitions defining in said chamber a first zone for oxidation and a second zone for reduction; said partitions including means for providing a hermetic seal between upper portions of said first zone and said second zone for a gas phase located above slag melt disposed on molten low carbon steel melt in said chamber;

first means for charging powder slag forming flux material into said first zone for oxidation;

second means for charging bulk iron containing raw material into said first zone for oxidation;

oxygen-fuel burning torch means disposed in said first zone for oxidation, said oxygen-fuel burning torch means including means for moving slag melt on the surface of the molten low carbon steel melt continuously around the circular melt chamber in a selected direction;

third means for introducing iron reductant into said second zone for reduction at a location near entry of said moving slag melt into said second zone;

fourth means for removing molten low carbon steel from said second zone for reduction for transfer outside the melt chamber;

fifth means for removing slag melt from the second zone for reduction for transfer outside the melt chamber positioned at a location at an exit section of said second zone with respect to the direction of the movement of the moving slag melt.

15. A device according to claim 14 wherein said oxygen-fuel burning torch means comprises vertically oriented elongated members defining tuyeres and having nozzles at a lower portion, said nozzles having orifices directed for moving the slag melt in the selected direction around the melt chamber.

16. A device according to claim 14 wherein said first zone for oxidation has a middle section and said second means for charging bulk iron containing raw material includes a scrap-charging hole located in said middle section with additional oxygen and/or fuel oxygen tuyeres located at both sides of said scrap charging hole for melting the charged material.

17. A device according to claim 14 wherein said first zone for oxidation has a second half with respect to the direction of the moving slag melt and said second half has a beginning portion with respect to the direction of the moving slag melt, and means for introducing iron reductant into the slag melt and additional fuel-oxygen tuyeres are located at the beginning of said second half of said first zone for oxidation.

18. A device according to claim 14 wherein said second zone for reduction has an initial section with respect to the direction of the moving slag melt and includes means for introducing liquid cast iron into the moving slag melt in the initial section of said second zone for reduction, and said initial section of said second zone for reduction is followed by a precipitation section for precipitating reduced iron.

19. A device according to claim 14 wherein said second zone for reduction is provided with safety valve means for excess gas pressure removal.

20. A device according to claim 14 wherein said second zone for reduction is provided with gas ejector means for removing gas from a gas cavity above moving slag melt in said second zone for reduction and means for supplying said removed gas to said oxygen-fuel burning torch means for use as fuel.

* * * * *